United States Patent [19]

Kusser

[11] Patent Number: 4,856,231

[45] Date of Patent: Aug. 15, 1989

[54] MACHINE FOR GRINDING LARGE BALLS

[76] Inventor: Josef Kusser, Renholding 29, 8359 Aicha v. W. Ndb., Fed. Rep. of Germany

[21] Appl. No.: 212,382

[22] Filed: Jun. 27, 1988

[30] Foreign Application Priority Data

Jun. 30, 1987 [DE] Fed. Rep. of Germany ..... 3721592

[51] Int. Cl.[4] ..... B24B 5/00

[52] U.S. Cl. ..... 51/129; 51/131.2; 51/216 T; 51/161; 51/289 S; 125/2

[58] Field of Search ..... 51/129, 131.1, 131.2, 51/289 S, 216 T, 149, 154, 161; 125/2

[56] References Cited

U.S. PATENT DOCUMENTS

| | | | |
|---|---|---|---|
| 998,101 | 10/1910 | Laabs . | |
| 2,998,676 | 4/1960 | Hawkins et al. | 51/45 |
| 3,289,354 | 12/1966 | Stevens et al. | 51/289 S |
| 3,739,531 | 5/1971 | Sharbaugh | 51/289 |

*Primary Examiner*—Frederick R. Schmidt
*Assistant Examiner*—Maurina Rachuba
*Attorney, Agent, or Firm*—Armstrong, Nikaido Marmelstein Kubovcik & Murray

[57] ABSTRACT

A machine for grinding large balls, in particular of natural or artificial stone, comprises a dish-shaped grinding tool and an arrangement for moving a ball blank in the grinding tool; the grinding tool is arranged vertically above the ball blank which is mounted and rotated on rollers; the ball blank and the grinding tool are pressed resiliently against each other.

14 Claims, 3 Drawing Sheets

MACHINE FOR GRINDING LARGE BALLS

BACKGROUND OF THE INVENTION

1. Field of the Invention

The invention relates to a machine for grinding large balls, in particular of natural or artificial stone, comprising a dish-shaped grinding tool which is arranged vertically above the ball blank mounted on rolling bodies, at least one of which is driven, and a means for producing the grinding pressure between the ball blank and the grinding tool.

2. Description of the Prior Art

Whereas for grinding relatively small balls with a diameter of a few millimeters up to a few centimeters various techniques are available, the grinding of large balls, in particular of natural or artificial stone, still presents great difficulties. An example is a granite ball having a diameter of about 10 cm to 3 m as is required for so-called "floating balls", i.e. a large ball mounted in a dish by means of a liquid film, in particular a water film, and lifted by the hydrostatic liquid pressure; such a "floating ball" turns very easily because of the extremely low frictional forces between the dish and ball.

A machine for grinding large balls of the type set forth is known from U.S. Pat. No. 2,998,676 and comprises a dish-shaped grinding tool which is arranged vertically above a ball blank mounted on rolling bodies, of which at least one is driven. The necessary grinding pressure between the ball blank and the grinding tool is produced by a weight, the grinding tool being mounted on a pivotable lever arm.

A disadvantage with such a machine is the complex construction because the interchangeable grinding disc serving as grinding tool must be displaced by means of an adjustment mechanism parallel to the two rolling bodies supporting the ball blank; the guiding of the grinding disc must be with high accuracy and at the same time, however, compensate any deviations, inevitable in practice, in the diameter of the ball blank from the desired value. With relatively small objects, for example balls for ball bearings, this does not involve any difficulties. However, it is not readily possible to use the known machine to grind balls of natural or artificial stone having a diameter of 1 to 3 m with the desired precision of the order of magnitude of about same 100ths mm.

SUMMARY OF THE INVENTION

The invention is therefore based on the problem of providing a machine for grinding large balls of the type indicated with which even large balls having a diameter of up to 3 m can be very exactly ground without any problems.

According to a first aspect the invention therefore proposes in a machine for grinding large balls, in particular of natural or artificial stone, comprising a dish-shaped grinding tool which is arranged vertically above the ball blank mounted on rolling bodies, at least one which is driven, and a means for producing the grinding pressure between the ball blank and the grinding tool, the improvement that as rolling bodies three rollers are used, one of which is constructed as guiding roller pivotable about an axis askew with respect to its axis of rotation, wherein the rollers are arranged at a support carried freely movable on the machine frame via flexible connecting elements, and wherein the means for generating the grinding pressure engages said support.

According to a second aspect the invention proposes in a machine for grinding large balls, in particular of natural or artificial stone, comprising a dish-shaped grinding tool which is arranged vertically above the ball blank mounted on rolling bodies, at least one of which is driven, and a means for adjusting the grinding pressure between the ball blank and the grinding tool, the improvement that as rolling bodies three rollers are used, one of which is constructed as a guide roller pivotable about an axis askew with respect to its axis of rotation, wherein the dish-shaped grinding tool is mounted via flexible connecting elements freely movably on the machine frame, and wherein the grinding tool engages the means for compensating the weight of the grinding tool so that the desired grinding pressure arises.

Expedient embodiments are defined by the features of the subsidiary claims.

Admittedly, U.S. Pat. No. 3,739,531 already discloses a machine for grinding large balls of natural stone in which the ball blank is arranged in a rotating cup-shaped receiving container and is turned by legs of a cantilever arm about a horizontal axis. The ball blank is ground in contact with the edges of the rotating receiving container by means of an abrasive agent which is delivered by an automatic supply means to the ball blank. The legs of the cantilever arm contact the ball blank on each side of the vertical axis of the cup-shaped receiving container so as to hold said ball blank in said container in this manner. Neither rotatable rollers nor a balance-beam-like frame suspended freely movably on the machine frame are provided.

The advantages achieved with the present invention are based on the production of the necessary force for the engagement pressure by means of a sort of balance beam which carries at one end the rollers for the movement of the ball blank or the grinding tool and at the other end the means for producing or adjusting the grinding pressure between the ball blank and the grinding tool, in particular a counter weight.

The grinding tool in the embodiment of claim 1 or the rollers in the embodiment of claim 7 are arranged stationarily in each case, giving a very simple construction. Since only one or two rollers have to be driven whilst the third roller is constructed as guiding roller pivotable about an axis askew with respect to its axis of rotation and not driven, only relatively few moving parts are present, particularly since in the actual grinding state the balance-beam-like frame is in a state of unstable equilibrium, so that generally no further movements occur here. For the stable supporting of the ball blank the aforementioned three rollers suffice.

By temporary changing the drive speed of one of the two driven rollers the direction of movement of the ball blank can be changed so that a uniform grinding action is achieved on the entire surface of the ball blank.

Tests have shown that in this manner balls having a diameter of up to 1.2 m can be ground with an accuracy of a few 100ths mm.

As connecting elements chains, cables or ropes may be used which have the necessary mechanical strength.

Since the balance-beam-like frame is suspended freely movable on the machine frame it can execute horizontal movements practically without any resistance, said movements being able to be caused by irregularities in the surface of the ball blank to be ground; this compensation likewise contributes to the desired accuracy of the grinding operation.

BRIEF DESCRIPTION OF THE DRAWINGS

The invention is described in more detail hereinafter with the aid of an example of embodiment with reference to the accompanying schematic drawings, wherein.

DESCRIPTION OF THE PREFERRED EMBODIMENT

Figure 1:
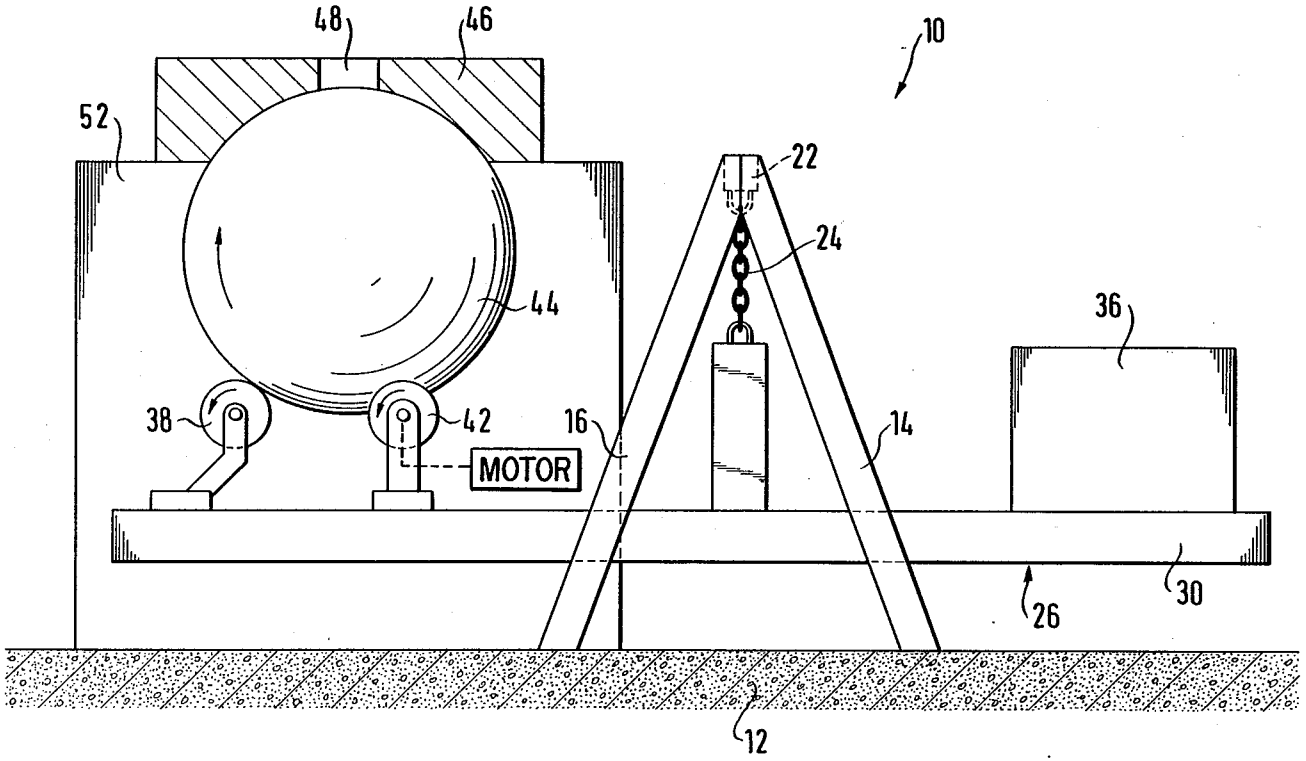
FIG. 1 is a side view of a first embodiment of a machine for grinding a large ball of natural or artificial stone.

The apparatus for grinding large balls indicated generally by the reference numeral 10 is mounted on a foundation 12 and has four support blocks 14, 16, 18 and 20 (in the side views of FIGS. 1 and 3 only the two front support blocks 14, 16 are shown) which are combined in pairs and carry a horizontal cross beam 22. The support blocks 14, 16 on the one hand and 18, 20 on the other are connected to each other and to the horizontal cross beam 22 to give a stable structure.

Suspended on the horizontal cross beam 22 are flexible connecting elements 24 in the form of two chains which carry together a support formed by a frame 26 which is rectangular in plan view. Said frame 26 comprises two beams 28, 30 which extend parallel to each other and are connected together at their ends by cross webs 32, 34 to give a stable structure.

At one end of said frame 26 (the right end in the view of FIG. 1) a means 36 for the production of the grinding pressure namely a counter weight is engaged, whilst on the other end of the frame 26 three rollers 38, 40, 42 are supported. The three rollers 38, 40, 42 are disposed at the corners of an equilateral triangle, i.e. the roller 38 is disposed substantially in the centre of the cross web 32 whilst the two other rollers 40, 42 are located on the two beams 28, 30 at equal distances from the roller 38.

Whereas one of the two rollers 40, 42 is driven, the roller 38 is freely rotatable, as well as pivotable about an axis askew with respect to its axis of rotation and serves as guide roller.

A ball blank 44 is placed on the three rollers 38, 40, 42 and has a weight which is less than the weight of the counter weight so that the bell blank 44 is pressed upwardly by means of the frame 26 against a dish-shaped grinding tool 46 with a central opening 48. An abrasive agent is supplied through the central opening 48 of the grinding tool 46, in which the ball blank 44 is centrally disposed.

Figure 2:
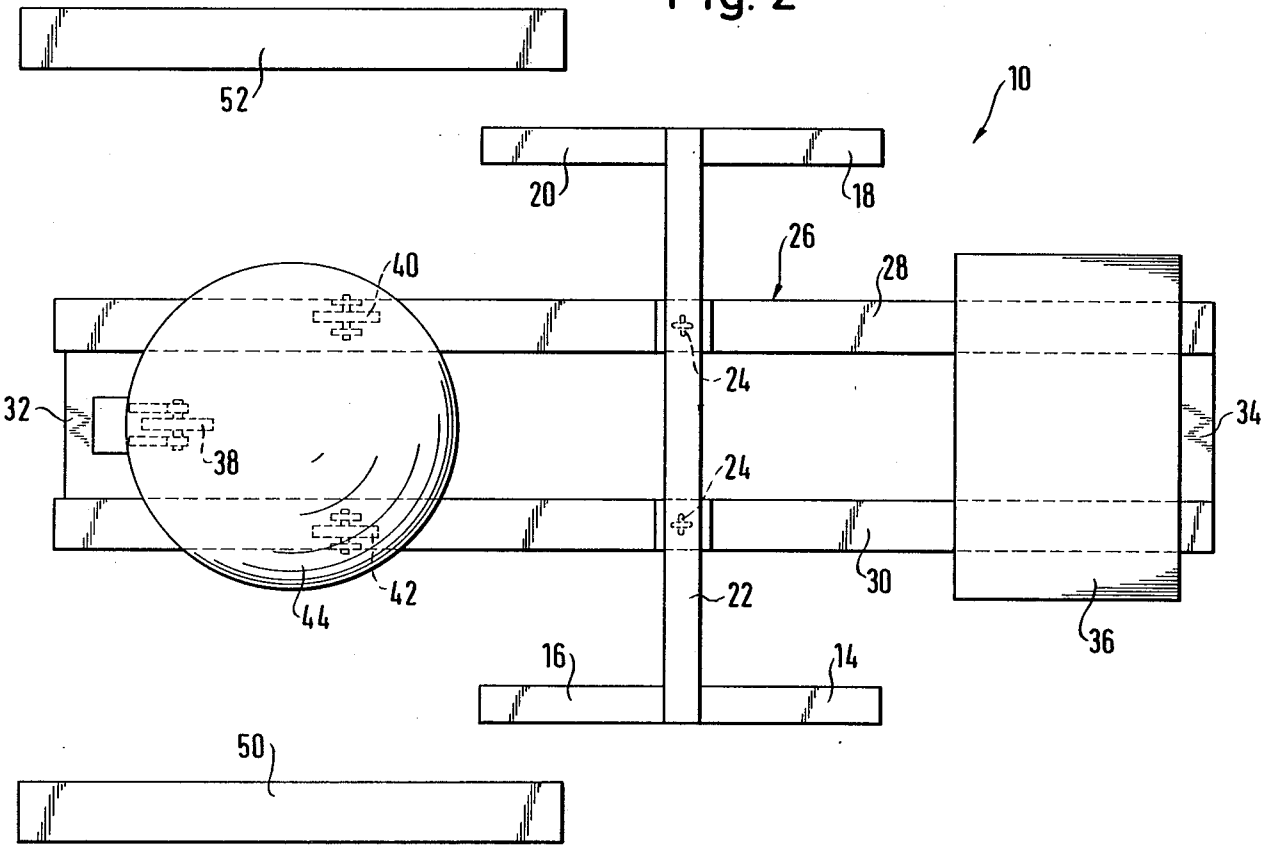
FIG. 2 is a plan view of said machine.

The counter weight thus serves for compensating the weight of the ball blank 44 as well as the rollers 38, 40, 42 with their holders and in addition for generating the force with which the ball blank 44 is pressed against the grinding tool 46. The mounting of the grinding tool 46 is indicated in FIG. 2 by the two beams 50, 52.

For grinding a ball blank 44 it is placed on the one side and the counter weight 36 on the other side on the frame 26; as explained above the weight of the counter weight 36 exceeds the weight of the ball blank 44 and that of the roller arrangement to such an extent that the desired application force is generated.

The two rollers 40, 42 are now set in rotational motion so that the ball blank 44 rotates. Due to the use of the three rollers 38, 40, 44 a stable position of the ball blank 44 is achieved, said blank being pressed with the desired force against the grinding tool 46 and simultaneously rotated.

To enable the entire surface of the ball blank 44 to be ground, from time to time one of the two rollers 40, 42 is rotated slower or faster and as a result the ball blank 44 is given a different direction of rotation and rotational speed.

The necesssary grinding pressure can be set by changing the weight of the counter weight 36, i.e. the grinding pressure can also be varied during the grinding operation of a ball blank 44 in that the weight of the counter weight is varied.

Due to the suspension of the frame 26 on the chains 24, or alternatively on cables, the position of the ball blank 44 immediately adapts itself to any horizontal movements due to irregularities in the surface of the ball blank 44.

Figure 3:
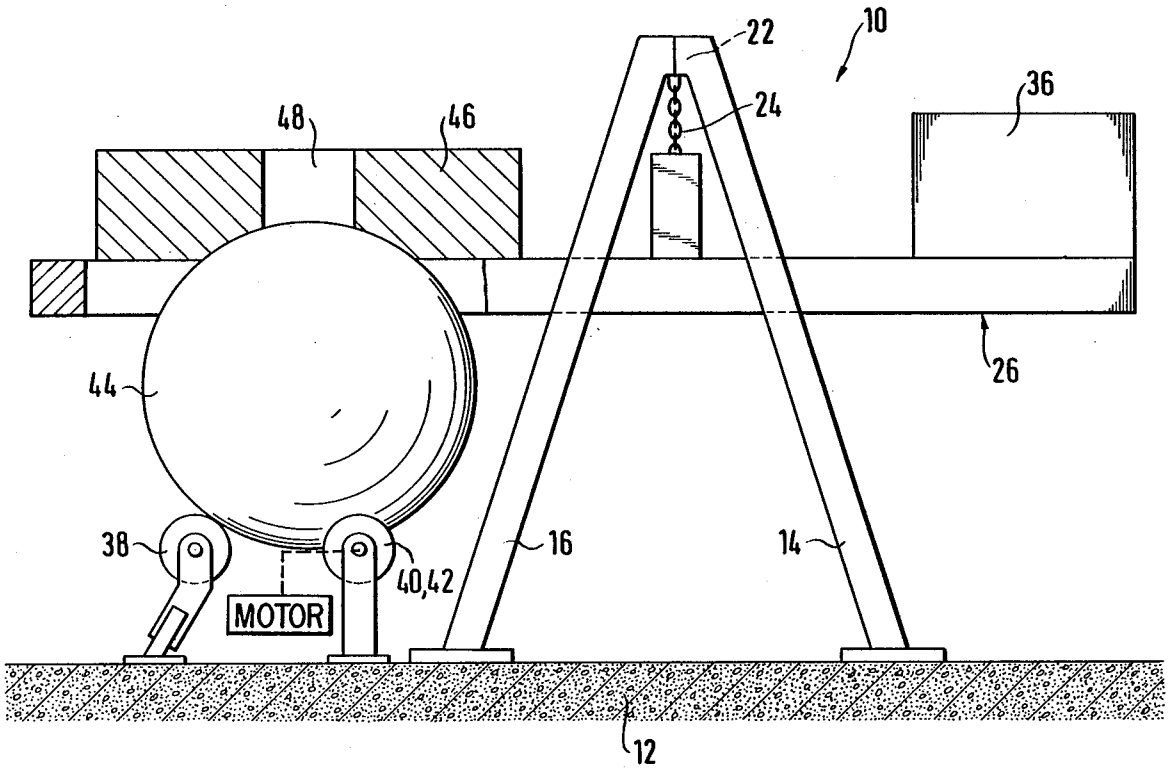
FIG. 3 is a side view of a further embodiment of a machine for grinding a large ball of natural or artificial stone.

FIG. 3 shows an illustration corresponding to FIG. 1 a side view of another embodiment of a machine for grinding large balls in which the rollers 38, 40, 42 are arranged stationarily on the foundation 12 whilst the grinding tool 46 bears on the end of the frame 26. The weight of the counter weight 36 is selected such that the desired application pressure is obtained when the ball blank 44 and the grinding tool 46.

I claim:

1. A machine for grinding large balls, particularly natural and artifical stone, comprising:

a frame, a support carried freely movable on the frame via flexible connecting elements, a disk-shaped grinding tool arranged vertically above a ball blank to be ground, rolling bodies arranged on the support, the ball blank being rollingly mountable on the rolling bodies, said rolling bodies comprising three rollers each having an axis of rotation, one of said three rollers being constructed as a guiding roller and being mounted on said support to be pivotable about a second axis askew with respect to its axis of rotation, means for driving at least one of said rollers, and means engaging said support for producing grinding pressure between the ball blank and the grinding tool.

2. A machine according to claim 1, wherein the connecting elements are chains, cables or ropes.

3. A machine according to claim 1, wherein the guiding roller has the same distance from each of the two other rollers.

4. A machine according to claim 1, wherein with a plurality of driven rollers the latter are adapted to be driven at times with different speed.

5. A machine according to claim 1, wherein said means for producing the grinding pressure is formed by a weight.

6. A machine according to claim 1, wherein the support is formed by a balance-beam-like frame suspended freely movably on the machine frame.

7. A machine according to claim 1, wherein said driving means drives at least two of said rollers at times with different speeds.

8. A machine for grinding large balls, particularly natural and artificial stone, comprising:

a frame, a support carried freely movable on the frame via flexible connecting elements, a disk-shaped grinding tool mounted on the support and arranged vertically above a ball blank to be ground, rolling bodies positioned below said grinding tool rollingly supporting the ball blank, said rolling bodies comprising three rollers each having an axis of rotation, one of said three rollers being constructed as a guiding roller and being mounted to be pivotable about a second axis askew with respect to its axis of rotation, means for driving at least one of said rollers, and means engaging said support for adjusting grinding pressure between the ball blank and the grinding tool.

9. A machine according to claim 8, wherein the connecting elements are chains, cables or ropes.

10. A machine according to claim 8, wherein the guiding roller has the same distance from each of the two other rollers.

11. A machine according to claim 8, wherein the plurality of driven rollers the latter are adapted to be driven at times with different speed.

12. A machine according to claim 8, wherein the means for adjusting grinding pressure is formed by a weight.

13. A machine according to claim 8 wherein said support is a balance-beam-like frame suspended freely movably on the machine from via the flexible connecting elements and wherein at one end of the balance-beam-like frame the grinding tool is arranged whereas at the other end of the frame the means for adjusting the grinding pressure is arranged.

14. A machine according to claim 8, wherein said driving means drives at least two of said rollers at times with different speeds.

* * * * *